US007389631B2

(12) United States Patent
Assirelli et al.

(10) Patent No.: US 7,389,631 B2
(45) Date of Patent: Jun. 24, 2008

(54) UNIT AND METHOD OF FEEDING CONTAINERS ARRANGED IN A NUMBER OF SUPERIMPOSED ROWS

(75) Inventors: Andrea Assirelli, Bologna (IT); Roberto Parmeggiani, Modena (IT)

(73) Assignee: G.D Societa' per Azioni, Bologna (IT)

( * ) Notice: Subject to any disclaimer, the term of this patent is extended or adjusted under 35 U.S.C. 154(b) by 0 days.

(21) Appl. No.: 11/715,964

(22) Filed: Mar. 9, 2007

(65) Prior Publication Data

US 2007/0157580 A1 Jul. 12, 2007

Related U.S. Application Data

(62) Division of application No. 11/122,306, filed on May 5, 2005.

(30) Foreign Application Priority Data

Oct. 28, 2004 (IT) ..... BO2004A0671

(51) Int. Cl.
*B65B 53/02* (2006.01)

(52) U.S. Cl. ..... 53/557; 53/442; 53/447; 53/540

(58) Field of Classification Search ..... 53/53, 53/442, 447, 540, 557
See application file for complete search history.

(56) References Cited

U.S. PATENT DOCUMENTS

| | | | | |
|---|---|---|---|---|
| 3,201,912 A | | 8/1965 | Wozniak | |
| 3,570,209 A | * | 3/1971 | Salwasser | 53/447 |
| 3,657,862 A | | 4/1972 | Milne | |
| 3,964,597 A | * | 6/1976 | Brown et al. | 198/432 |
| 4,263,769 A | * | 4/1981 | Hanazawa et al. | 53/448 |
| 4,843,800 A | | 7/1989 | Focke et al. | |
| 4,902,184 A | * | 2/1990 | Fritz | 414/790.3 |
| 4,932,190 A | | 6/1990 | Bergner et al. | |
| 4,934,129 A | * | 6/1990 | Hoffman et al. | 53/443 |
| 5,097,653 A | * | 3/1992 | Soloman | 53/499 |
| 5,216,870 A | * | 6/1993 | Boriani et al. | 53/448 |
| 5,462,401 A | | 10/1995 | Brizzi et al. | |
| 6,047,526 A | | 4/2000 | Draghetti et al. | |
| 6,158,193 A | | 12/2000 | Focke et al. | |

(Continued)

FOREIGN PATENT DOCUMENTS

CH 510556 A 7/1971

(Continued)

*Primary Examiner*—Thanh K. Truong
(74) *Attorney, Agent, or Firm*—Birch, Stewart, Kolasch & Birch, LLP

(57) ABSTRACT

A unit and method for feeding containers, whereby the containers, arranged in two superimposed rows, are fed along a horizontal path and through a reject station; upstream from the reject station, two superimposed containers are parted, by translation in a vertical direction, so as to travel, separately and facing each other, along the next portion of the path; immediately downstream from the reject station, two facing containers are brought back into contact with each other so as to travel, superimposed, along the next portion of the path; and the reject station has a first reject device for expelling only one container in a bottom row from the path, and a second reject device for expelling only one container in a top row from the path.

7 Claims, 4 Drawing Sheets

U.S. PATENT DOCUMENTS

| | | | |
|---|---|---|---|
| 6,511,405 | B1 | 1/2003 | Focke et al. |
| 6,688,077 | B1 | 2/2004 | Focke et al. |

FOREIGN PATENT DOCUMENTS

| | | | |
|---|---|---|---|
| EP | 0635429 | A1 | 1/1995 |
| EP | 0941929 | | 9/1999 |
| EP | 1 084 954 | A2 | 3/2001 |
| EP | 1084954 | A2 | 3/2001 |
| EP | 1 103 465 | A1 | 5/2001 |
| EP | 1103465 | | 5/2001 |

* cited by examiner

UNIT AND METHOD OF FEEDING CONTAINERS ARRANGED IN A NUMBER OF SUPERIMPOSED ROWS

This application is a Divisional of co-pending application Ser. No. 11/122,306, filed on May 5, 2005, the entire contents of which are hereby incorporated by reference and for which priority is claimed under 35 U.S.C. § 120.

The present invention relates to a unit and method of feeding containers arranged in a number of superimposed rows.

The present invention may be used to particular advantage on a cigarette packing line, to which the following description refers purely by way of example.

BACKGROUND OF THE INVENTION

A cigarette packing line normally comprises a manufacturing machine for producing the cigarettes; a filter assembly machine for applying filters to the cigarettes; a packing machine for producing soft or rigid packets of cigarettes; a cellophaning machine for applying an overwrapping of transparent plastic material to the packets of cigarettes; and a cartoning machine for producing cartons of packets of cigarettes.

A feed unit is interposed between the cellophaning machine and the cartoning machine to receive a succession of packets of cigarettes from an output of the cellophaning machine and transfer the succession of packets of cigarettes to an input of the cartoning machine. The feed unit often has a reject station located along the path of the packets of cigarettes to remove from the path any faulty packets of cigarettes detected by control stations on the cellophaning machine. Location of the reject station at the feed unit is usually advantageous on account of the considerable size of the reject station, which must also collect the rejected packets of cigarettes and is difficult to accommodate on the cellophaning machine.

Some known packing lines of the type described above are designed to transfer from the output of the cellophaning machine to the input of the cartoning machine a succession of packets of cigarettes arranged in two or more superimposed rows, so as to reduce the average travelling speed, and hence mechanical stress, of the packets of cigarettes.

When feeding packets of cigarettes arranged in two or more superimposed rows, rejection of a faulty packet of cigarettes travelling through the reject station calls for also rejecting the good packet/s stacked with it. This is due to the way in which known reject stations are built and operate, which does not permit removal from the stream of a single packet stacked with another.

The feed unit may also comprise a heat-shrink station for heat treating each packet of cigarettes. For each row of packets of cigarettes, the heat-shrink station comprises a respective channel, along which the row of packets of cigarettes travels in use, and which is bounded at the top and bottom by two slide surfaces equipped with electric heating elements. When a packet of cigarettes is pushed along the respective channel at the heat-shrink station, the major lateral walls of the packet of cigarettes inevitably slide along the heated slide surfaces, thus generating friction on the packet of cigarettes, which is a function of the pressure exerted on the packet by the slide surfaces. To avoid subjecting the packet of cigarettes to severe friction which might damage or even tear the sheet of overwrapping material, the slide surfaces are spaced far apart. Such a solution, however, reduces the effectiveness of the heat treatment and calls for using very long heat-shrink stations.

SUMMARY OF THE INVENTION

It is an object of the present invention to provide a unit and method of feeding containers arranged in a number of superimposed rows, which unit and method are designed to eliminate the aforementioned drawbacks and, in particular, are cheap and easy to implement.

According to the present invention, there are provided a unit and method of feeding containers arranged in a number of superimposed rows, as claimed in the accompanying Claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
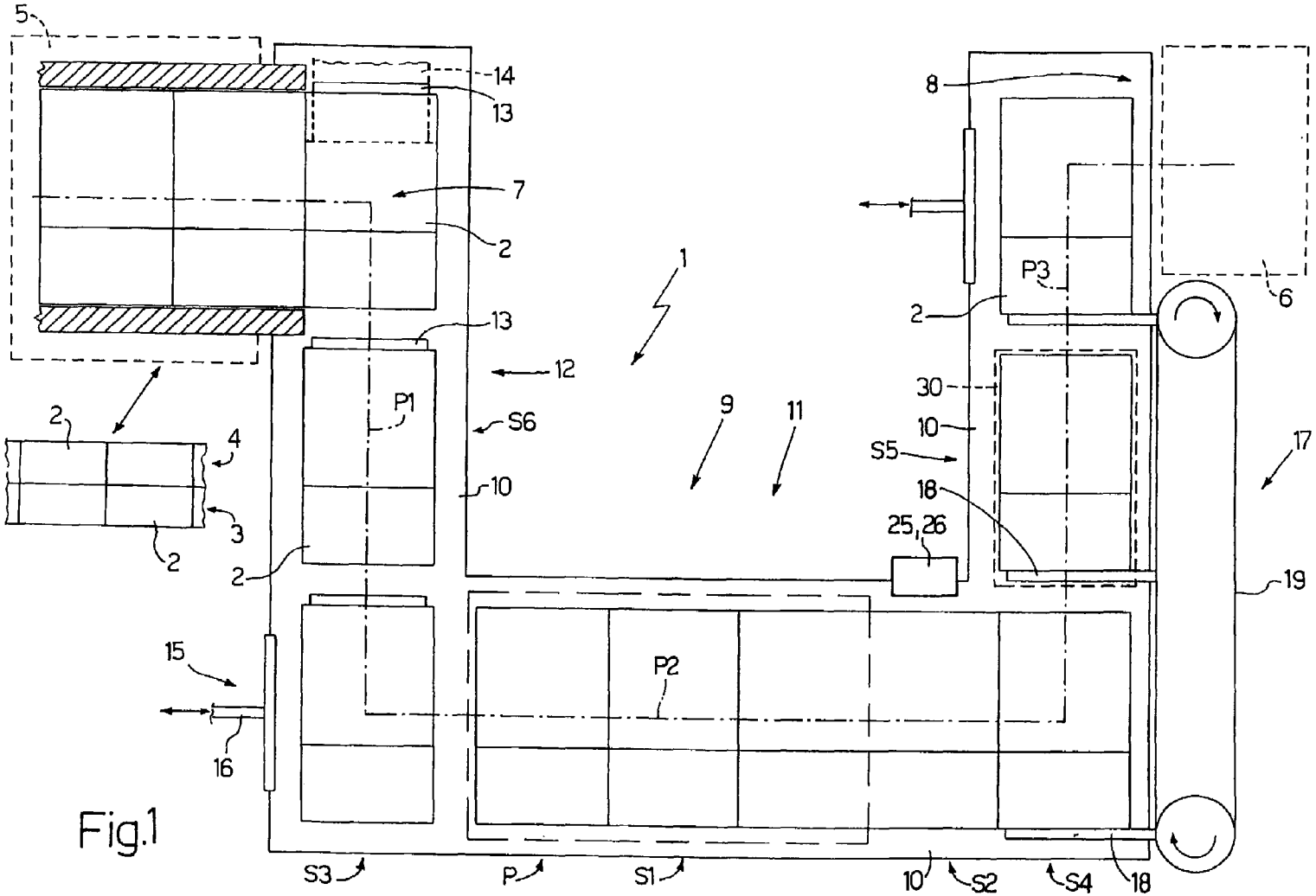
FIG. 1 shows a schematic plan view, with parts removed for clarity, of a feed unit in accordance with the present invention and located between an output of a cellophaning machine and the input of a cartoning machine.

Number 1 in FIG. 1 indicates as a whole a feed unit for feeding containers or packets 2 of cigarettes arranged in two superimposed, respectively bottom and top, rows 3 and 4. Feed unit 1 forms part of a cigarette packing line comprising a cellophaning machine 5 for applying an overwrapping of transparent plastic material to packets 2 of cigarettes; and a cartoning machine 6 for producing cartons of packets 2 of cigarettes. More specifically, feed unit 1 is interposed between cellophaning machine 5 and cartoning machine 6, receives a succession of packets 2 of cigarettes from an output 7 of cellophaning machine 5, and transfers the succession of packets 2 of cigarettes to an input 8 of cartoning machine 6.

Feed unit 1 comprises a conveying device 9 for feeding packets 2 along a horizontal U-shaped path P extending from output 7 of cellophaning machine 5 to input 8 of cartoning machine 6. More specifically, path P comprises a linear start portion P1; a linear intermediate portion P2 perpendicular to start portion P1; and a linear end portion P3 parallel to start portion P1.

Conveying device 9 comprises a U-shaped slide surface 10 parallel to path P and for supporting packets 2 in sliding manner; and a push device 11 for pushing packets 2 along slide surface 10. Push device 11 comprises a pusher 12 having a number of push members 13 fitted to an endless belt 14 (shown only partly), and which pushes packets 2 along start portion P1; a pusher 15 having a 16 with a linear reciprocating movement, and which pushes packets 2 along intermediate portion P2; and a pusher 17 having a number of push members 18 fitted to an endless belt 19, and which pushes packets 2 along end portion P3.

Figure 2:
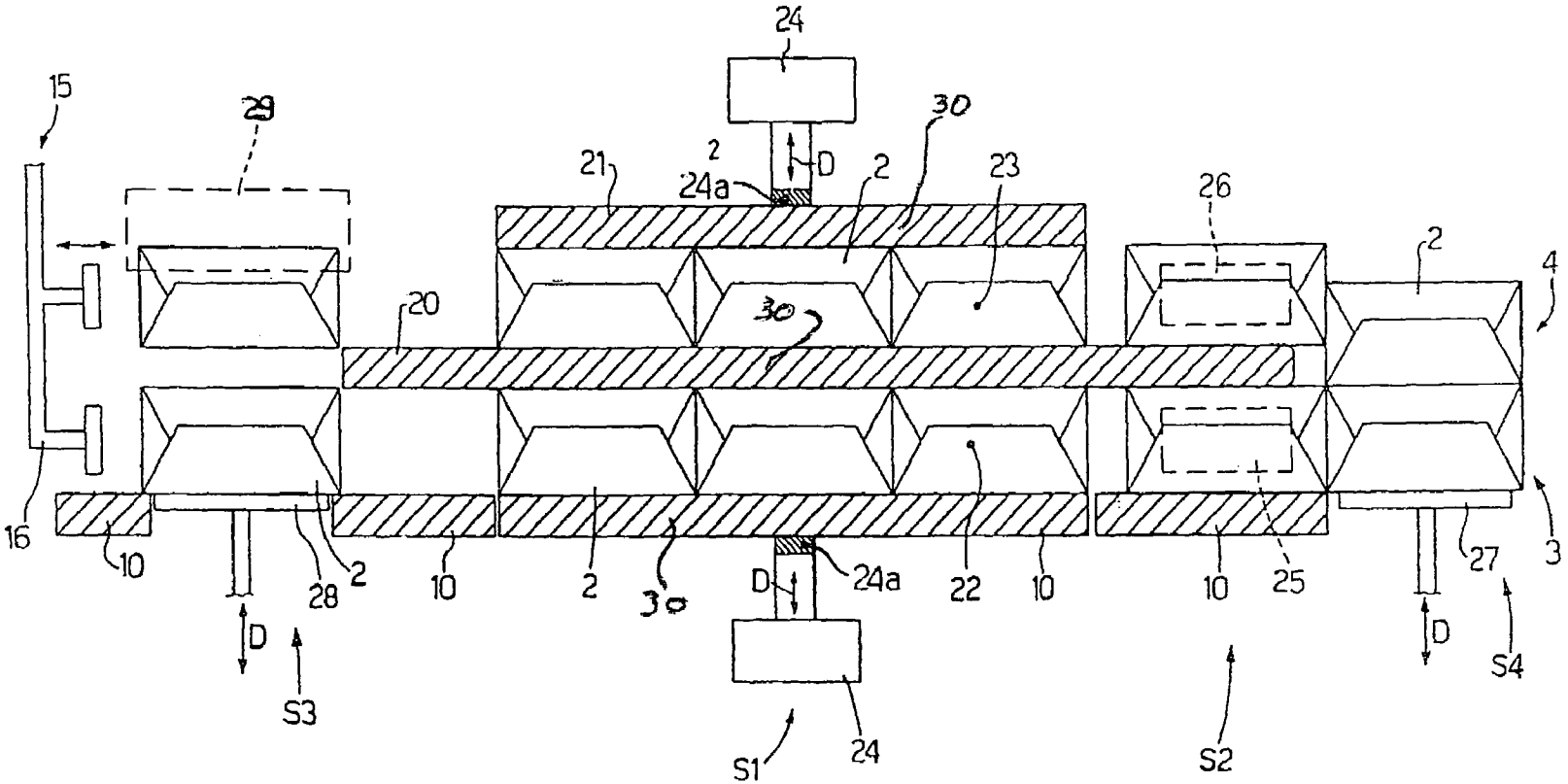
FIG. 2 shows a schematic lateral section of part of the FIG. 1 feed unit.

As shown in FIG. 2, a heat-shrink station S1, for heat treating each packet 2, and a reject station S2, for expelling any faulty packets 2 from path P, are arranged in succession along intermediate portion P2 of path P.

Upstream from heat-shrink station S1, and therefore upstream from reject station S2, is located a parting station S3 where two superimposed packets 2 are parted by translation in a vertical direction D perpendicular to path P, so as to travel separately and facing each other along the next portion of path P. Immediately downstream from reject station S2, and therefore downstream from heat-shrink station S1, is located a stacking station S4 where two facing packets 2 are brought back into contact with each other by translation in a vertical direction D, so as to travel, superimposed, along the next portion of path P.

In other words, rows 3 and 4 of packets 2 travel, superimposed, along path P with the exception of the portion of intermediate portion P2 of path P extending between parting station S3 and stacking station S4; along which portion, rows 3 and 4 of packets 2 are fed parted and facing each other by conveying device 9, and in particular pusher 15.

Heat-shrink station S1 comprises a further two slide surfaces 20 and 21, which are parallel to and face slide surface 10 to define, with slide surface 10, two channels 22 and 23, along which respective rows 3 and 4 of packets 2 are fed. More specifically, the bottom row 3 of packets slides along slide surface 10 and inside channel 22 defined between slide surface 10 and slide surface 20, while the top row 4 of packets slides along slide surface 20 and inside channel 23 defined between slide surface 20 and slide surface 21.

Slide surfaces 10, 20, 21 comprise electric heating elements 30, which are embedded inside slide surfaces 10, 20, 21 and controlled to heat channels 22, 23 to a given temperature, which normally depends on the traveling speed of packets 2 along path P, and on the type of plastic overwrapping material (not shown) applied to packets 2.

In a preferred embodiment, slide surfaces 10 and 21 at heat-shrink station S1 are movable in a vertical direction D perpendicular to path P, and heat-shrink station S1 comprises two actuating devices 24 for moving slide surfaces 10 and 21 cyclically in vertical direction D perpendicular to path P, so as to move slide surfaces 10 and 21 cyclically towards and away from slide surface 20. In a preferred embodiment, both actuating devices 24 form part of the same mechanism, i.e., are powered by a common motor. In an alternative embodiment, the two actuating devices 24 are mechanically independent.

More specifically, conveying device 9 feeds packets 2 along path P with an intermittent movement comprising a cyclic succession of travelling steps and hold steps. And actuating devices 24 are timed with conveying device 9 to keep slide surfaces 10 and 21 close to slide surface 20 during the hold steps, and away from slide surface 20 during the travelling steps in the intermittent movement. This has the dual effect of permitting unimpeded travel of packets 2 along path P, and increasing heat transmission to packets 2 by virtue of sliding surfaces 10, 20, 21 firmly contacting packets 2.

The actual size of packets 2 varies fairly widely on account of inevitable tolerances as regards both materials and packing processes. Between each actuating device 24 and respective slide surface 10, 21, an elastic member 24*a* is therefore preferably interposed to allow a certain amount of flexible self-adjustment of the position of slide surface 10, 21 in vertical direction D. This is particularly useful by enabling slide surfaces 10 and 21 to adapt automatically to the actual size of packets 2.

In other words, by means of elastic members 24*a*, substantially constant pressure is applied on each packet 2 regardless of the actual size of packet 2.

By way of example, each elastic member 24*a* interposed between each actuating device 24 and respective slide surface 10, 21 is defined by a spring, a pneumatic shock absorber, or an elastomer.

Reject station S2 comprises a reject device 25 for only expelling one bottom packet 2, i.e., in bottom row 3 of packets 2, from path P; and a reject device 26 for only expelling one top packet 2, i.e., in top row 4 of packets 2, from path P. Each reject device 25, 26 preferably comprises a pneumatic push device (not shown in detail) for pushing a packet 2 off path P in a horizontal direction perpendicular to path P.

Slide surface 20 ends at stacking station S4, so that the packets 2 in top row 4 travelling along slide surface 20 are eventually unsupported from underneath and drop by force of gravity onto packets 2 in bottom row 3. In the event a packet 2 in bottom row 3 is expelled at reject station S2, the corresponding packet 2 in top row 4 would have too far to fall at stacking station S4 and may become misaligned, so stacking station S4 comprises a supporting surface 27 movable, in a vertical direction D perpendicular to path P, between a withdrawn position, in which a top face of supporting surface 27 is aligned with a top face of slide surface 10, and a raised position, in which the top face of supporting surface 27 is raised with respect to the top face of slide surface 10.

When a packet 2 in bottom row 3 and a corresponding packet 2 in top row 4 are both present, supporting surface 27 is maintained in the withdrawn position, and, at the end of slide surface 20, packet 2 in top row 4 drops a short distance vertically onto packet 2 in bottom row 3. When only a packet 2 in top row 4 is present, with no corresponding packet 2 in bottom row 3, supporting surface 27 is moved into the raised position to break the free fall of packet 2 in top row 4 and guide packet 2 down in controlled manner as supporting surface 27 moves back down into the withdrawn position.

Parting station S3 comprises a supporting surface 28 movable, in a vertical direction D perpendicular to path P, between a withdrawn position, in which a top face of supporting surface 28 is aligned with a top face of slide surface 10, and a raised position, in which the top face of supporting surface 28 is raised with respect to the top face of slide surface 10 and aligned with a top face of slide surface 20. Parting station S3 also comprises a clamping device 29 aligned vertically with supporting surface 28 and for clamping a packet 2 in a given vertical position slightly above slide surface 20. In one embodiment, clamping device 29 comprises a suction member (not shown). In an alternative embodiment, clamping device 29 comprises a gripper (not shown) having two jaws movable in a direction crosswise to path P and in opposition to elastic means.

Figure 5:
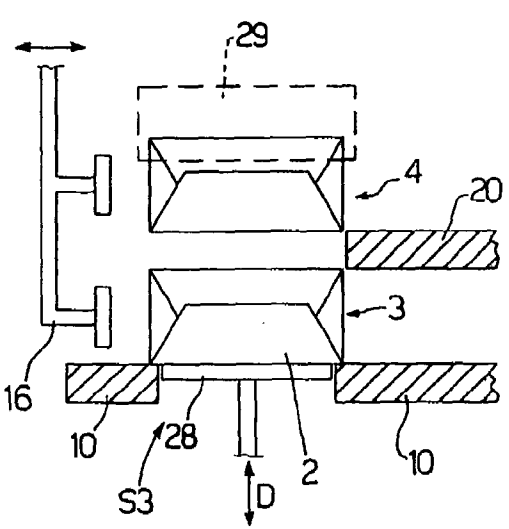
FIGS. 3 to 5 show schematic lateral sections of three instants in the operation of a parting station of the FIG. 1 feed unit.
Figure 4:
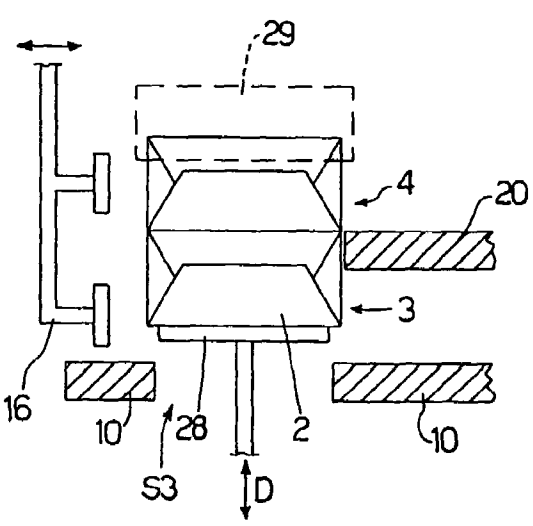
Figure 3:
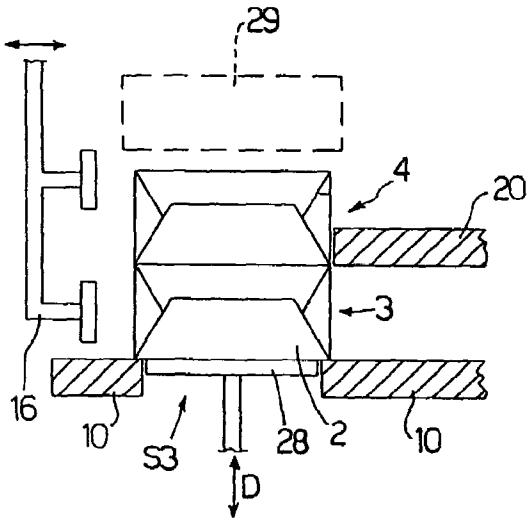

In actual use, and as shown in FIGS. 3 to 5, when a packet 2 in bottom row 3 and a corresponding packet 2 in top row 4 reach parting station S3, supporting surface 28 is moved from the withdrawn to the raised position to lift both packet 2 in bottom row 3 and corresponding packet 2 in top row 4 and bring packet 2 in top row 4 into contact with clamping device 29. At this point, packet 2 in top row 4 remains in contact with clamping device 29, and, as supporting surface 28 moves back down into the withdrawn position, is parted from packet 2 in bottom row 3 (resting on supporting surface 28).

As shown in FIG. 1, a known filler station S5 is located downstream from reject station S2 to transfer a number of packets 2 to conveying device 9 to replace any packets 2 expelled at reject station S2. Filler station S5 comprises a vertical hopper 30 containing a stack of superimposed packets 2 and having an outlet located over conveying device 9.

Figure 6:
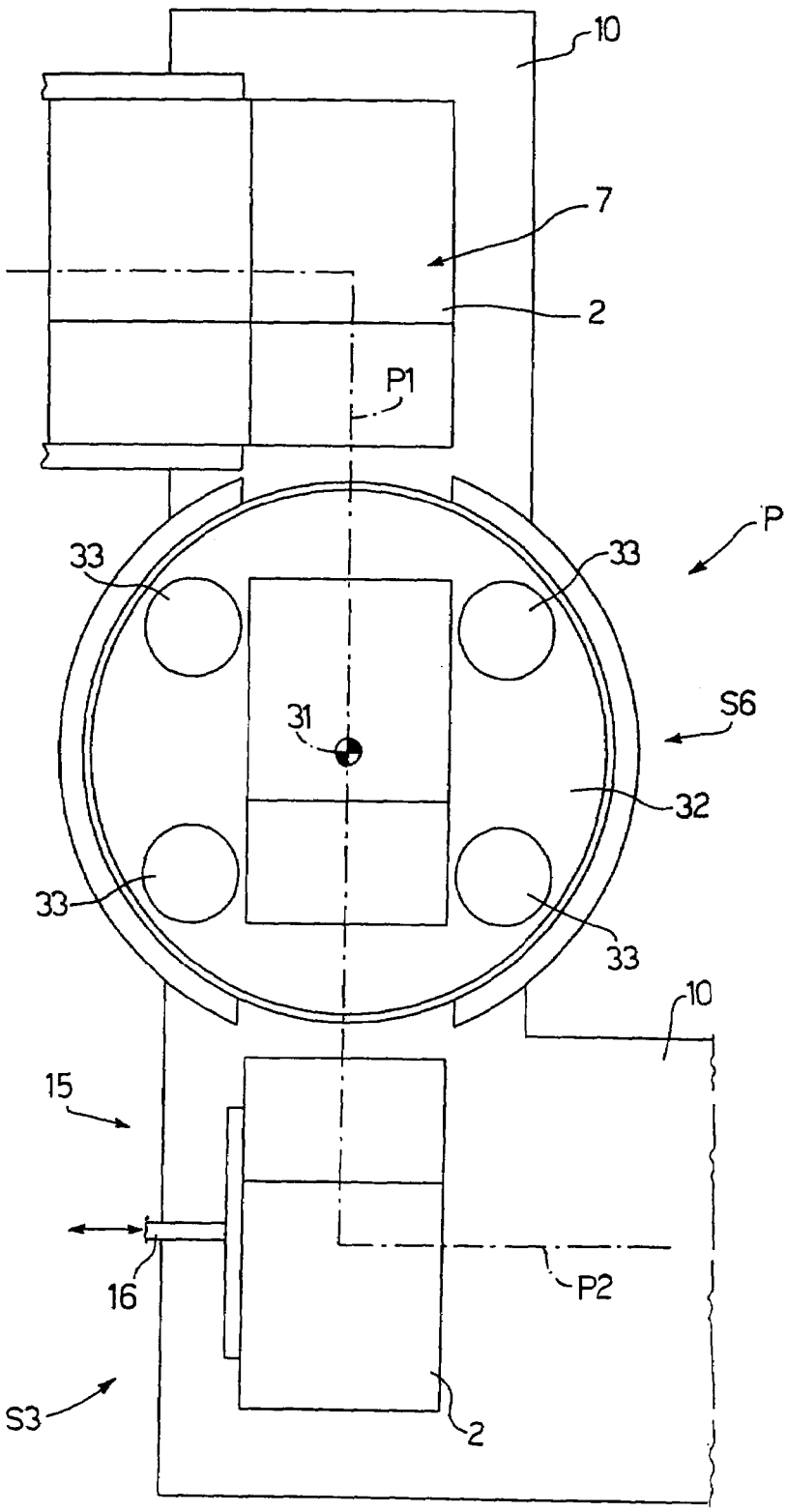
FIG. 6 shows a schematic plan view of a rotation station of the FIG. 1 feed unit.

As shown in FIG. 6, conveying device 9 preferably comprises a rotation station S6 for rotating each packet 2 by 180° about a vertical axis 31 perpendicular to path P. Rotation station S6 comprises a horizontal turntable 32 having four vertical members 33 projecting upwards from turntable 32 and arranged to enclose packets 2.

Reject station S2 as described above has numerous advantages by enabling, even in the case of packets of cigarettes arranged in two or more superimposed rows, rejection of either all or only one of the packets in a given stack, regardless of the location of the rejected packet.

Heat-shrink station S1 as described above has numerous advantages by permitting unimpeded travel of packets 2 along path P, while at the same time increasing heat transmission to packets 2 by virtue of slide surfaces 10, 20, 21 firmly contacting packets 2.

Given its numerous advantages, feed unit 1 as described above may also be used to advantage at other points along a cigarette packing line, or even on other automatic machines for packing other than cigarettes (e.g., food products).

The invention claimed is:

1. An apparatus for conveying containers arranged in a plurality of superimposed rows which comprises:

a conveying means for conveying the containers, arranged in at least two superimposed rows, along a horizontal path (P), and a heat-shrink station (S1) for heat treating each of said; containers, said heat-shrink station (S1) including a first slide surface disposed parallel to the path (P) for supporting, in a sliding manner, the containers in a bottom row;

a second slide surface disposed parallel to and facing the first slide surface and for supporting, in sliding manner, the containers in a top row; and a third slide surface disposed parallel to and facing the second slide surface;

a first heated channel, along which the bottom row of containers travels, said first heated channel being defined by the first slide surface and the second slide surface;

a second heated channel, along which the top row of containers travels, said second heated channels being defined by the second slide surface and the third slide surface; and actuating means for cyclically moving the first and third slide surfaces in a vertical direction (D), perpendicular to the path (P), whereby the first and third slide surfaces are moved in opposite directions toward and away from the second slide surface which is disposed between the first and third slide surfaces.

2. The apparatus as claimed in claim 1, wherein the conveying means convey the containers along the path (P) with an intermittent movement comprising a cyclic succession of traveling steps and holding steps; and the actuating means are timed with the conveying means to keep the first and third slide surfaces close to the second slide surface during the holding steps in the intermittent movement, and to keep the first and third slide surfaces away from the second slide surface during the traveling steps in said intermittent movement.

3. The apparatus as claimed in claim 1, wherein the slide surfaces contain electric heating elements.

4. The apparatus as claimed in claim 1, wherein respective elastic members are interposed between the actuating means and the first and third slide surfaces to permit elastic, self-adjustment of the position of the first and third slide surfaces in the vertical direction (D).

5. An apparatus for conveying containers arranged in at least one row which comprises;

conveying means for conveying the containers along a horizontal path (P) with an intermittent movement including a cyclic succession of traveling stops and holding steps, a heat-shrink station (S1) for heat treating each container; the heat-shrink station (S1) comprising a first slide surface disposed parallel to the path (P) for supporting the containers, in a sliding manner, and a second slide surface parallel to and facing the first slide surface; a heated channel, along which the row of containers travels, said heated channel being defined by the first slide surface and the second slide surface;

an actuating device for moving the first slide surface cyclically with respect to the second slide surface in a vertical direction (D) crosswise to the path (P), whereby the first and second slide surfaces are moved cyclically towards and away from each other; and an elastic member interposed between the actuating device and the first slide surface to permit elastic self-adjustment of the position of the first slide surface in the vertical direction (D), wherein means are provided for timing the actuating device with the conveying means to keep the first and second slide surfaces close to each other during the holding steps in the intermittent movements and to keep the first and second slide surfaces away from each other during the traveling steps in the intermittent movement.

6. The apparatus as claimed in claim 5, wherein the first and second slide surfaces includes electric heating elements.

7. An apparatus for conveying containers in at least one row, said apparatus comprising:

conveying means for conveying the containers along a horizontal path (P) with an intermittent movement comprising a cyclic succession of traveling steps and hold steps;

a heat-shrink station (S1) for heat treating each container; the heat shrink station (S1) including a first slide surface disposed parallel to the path (P) for supporting the containers in a sliding manner, and a second slide surface disposed parallel to and facing the first slide surface said first slide surface and said second slide surface defining a heated channel along which a row of containers travel, an actuating device for moving the first slide surface cyclically with respect to the second slide surface in a vertical direction (D) crosswise to the path (P), so as to cyclically move the first and second slide surfaces towards and away from each other;

wherein means are provided for timing the actuating device with the conveying means to keep the first and second slide surfaces close to each other during the holding steps in the intermittent movement, and to keep the first and second slide surfaces away from each other during the traveling steps in said intermittent movement.

* * * * *